US006729167B2

(12) United States Patent
Fredriksson et al.

(10) Patent No.: US 6,729,167 B2
(45) Date of Patent: May 4, 2004

(54) KEY SAFEKEEPING DEVICE

(75) Inventors: Robert Fredriksson, Eskilstuna (SE); Daniel Andersson, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 0 days.

(21) Appl. No.: 10/305,975

(22) Filed: Nov. 29, 2002

(65) Prior Publication Data

US 2003/0097861 A1 May 29, 2003

(30) Foreign Application Priority Data

Nov. 29, 2001 (SE) ..... 0104007

(51) Int. Cl.[7] ..... B65D 55/14

(52) U.S. Cl. ..... 70/63; 70/371; 70/389; 70/451; 109/50

(58) Field of Search ..... 109/50–52; 70/63, 70/371, 389, 390, 456 R, 451, 461, 466

(56) References Cited

U.S. PATENT DOCUMENTS

| | | | | |
|---|---|---|---|---|
| 1,885,692 A | | 11/1932 | Dugan | |
| 3,307,384 A | | 3/1967 | Sinervo | |
| 4,296,617 A | | 10/1981 | Campagna | |
| 4,406,140 A | * | 9/1983 | Wolter | 70/389 X |
| 4,441,348 A | * | 4/1984 | Neilsen | 70/389 |
| 4,448,051 A | * | 5/1984 | Neilsen | 70/389 |
| 4,570,469 A | * | 2/1986 | Neilsen | 70/389 |
| 5,060,491 A | * | 10/1991 | Smith | 70/63 |
| 5,156,030 A | * | 10/1992 | Hill et al. | 70/63 |
| 5,907,963 A | * | 6/1999 | Myers et al. | 70/371 |
| 6,209,370 B1 | * | 4/2001 | Larson et al. | 70/389 |

FOREIGN PATENT DOCUMENTS

| | | |
|---|---|---|
| DE | 296 23 441 U1 | 10/1998 |
| WO | WO 97/04200 A1 | 2/1997 |

* cited by examiner

*Primary Examiner*—Suzanne Dino Barrett
(74) *Attorney, Agent, or Firm*—Sughrue Mion, PLLC

(57) ABSTRACT

A key safekeeping device for fitting into a hole in a door, wall or corresponding structure includes a first tubular element (10) that carries a first collar (12) on an outer end thereof. A lock cylinder (14) is detachably fitted to the first tubular element. A second tubular element (20) that carries a second collar (22) is intended for lockable engagement with the first tubular element. At least one of the collars is comprised of a separate ring-shaped part (22) that includes an internal aperture for receiving a blocking means (24) in the form of a bent/curved element that is intended to be fitted into a peripheral groove **(20*c*)** in the barrel surface of the second tubular element. The blocking element, which lies hidden in the aperture of the ring-shaped part, cannot therefore be removed when the key safekeeping device is fitted and the lock cylinder is mounted in place. Because the collars can be produced as separate parts, the key safekeeping device can be manufactured from tubing of any appropriate material thickness, therewith minimizing the cutting work required in manufacture. This provides gains with respect to tool costs, material consumption, working time and therewith also in respect of the environment.

11 Claims, 4 Drawing Sheets

KEY SAFEKEEPING DEVICE

FIELD OF INVENTION

The present invention relates generally to key safekeeping devices and more particularly to a so-called key safekeeping tubular unit intended to be fitted into a hole in a door, wall or corresponding structure.

DESCRIPTION OF THE BACKGROUND ART

Various key safekeeping devices of this kind are known to the art. One example of such devices is described in Swedish Patent Publication SE 506 752. This device includes a tubular unit and a safekeeping element, which are mutually connected by means of a threaded joint. When the safekeeping device is intended to be fitted to a door, the tubular unit and the safekeeping element are screwed together until the right length has been obtained with regard to the thickness of the door, wherewith an attachment flange abuts the outside of the door while a corresponding flange abuts the inside of said door. Relative rotation between the two parts is blocked by means of a latching device that extends through openings in said two parts.

This solution provides a device that fulfils high security requirements. One drawback with this solution, however, is that the tubular unit and the safekeeping element must both be produced from a thick-walled tubular blank, due to the necessity of providing flanges or collars at one end of respective parts.

SUMMARY OF THE INVENTION

One object of the present invention is to provide a key safekeeping device of the aforedescribed kind with which the requirement of a thick tubular blank is avoided without detracting from the high security requirement.

The invention is based on the insight that the security level of such a device can be retained with the aid of separate rings that are mounted on tubular parts and that function as flanges or collars.

Accordingly, the present invention provides a key safekeeping device as defined in the accompanying claim 1.

In one preferred embodiment, a barrel surface of one of the tubular parts includes a plurality of peripherally disposed grooves intended for receiving a blocking element, thereby enabling the key safekeeping device to be readily adapted to doors or walls of different thicknesses.

Further preferred embodiments are defined in the dependent claims.

The inventive arrangement provides a key safekeeping device, in which the separate flanges are integrated with remaining parts in a satisfactory manner from security aspects, since the blocking element makes dismantling of the separate flanges impossible to achieve unless one has access to the correct key. This mutual separation of the tubular element and the collars enables manufacture of the key safekeeping tubular unit to be rationalized. This solution enables the key safekeeping device to be produced from tubing of suitable thickness, therewith minimizing the cutting work required. This provides gains with respect to tool costs, the use of material, manufacturing time and therewith also the environment.

The separation of the collars from the tubular elements also enables different surface treatments to be used and also the use of collars of different configurations, therewith changing the appearance of the key safekeeping tubular unit so that it will blend in with other features.

BRIEF DESCRIPTION OF THE DRAWINGS

The invention will now be described by way of example and with reference to the accompanying drawings, in which.

DETAILED DESCRIPTION OF PREFERRED EMBODIMENTS

A preferred embodiment of an inventive key safekeeping device will now be described. Those components that are located on or against the outer surface of a door, to the left in the figures, have been designated the descriptive word "outer", whereas those components that are located on or against the inner surface of a door, to the right in the figures, have been designated the descriptive word "inner".

Figures 1, 2:
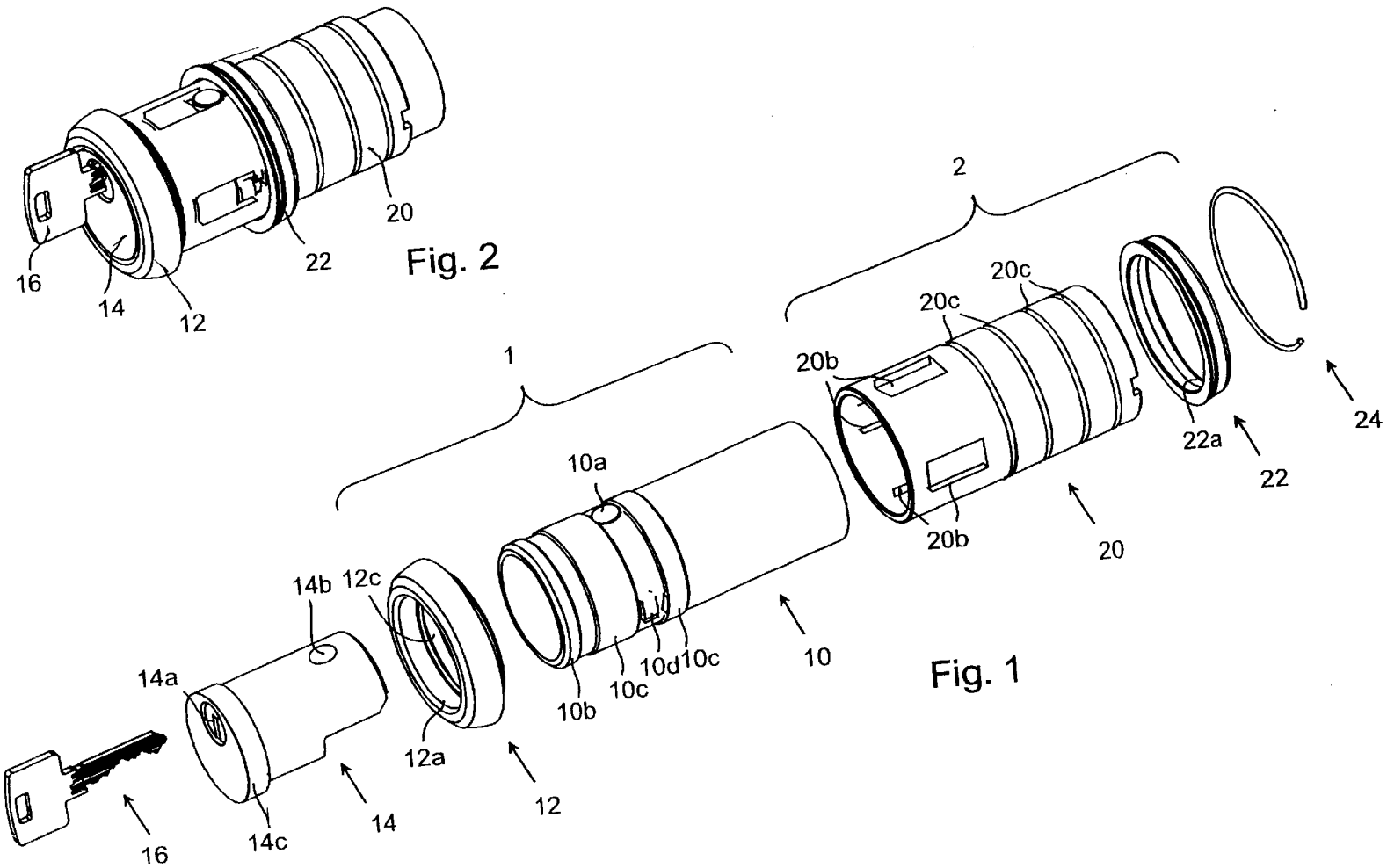
FIG. 1 is an exploded perspective view of the components of the key safekeeping device.
FIG. 2 is a perspective view of an assembled key safekeeping device according to the invention.

FIG. 1 is an exploded perspective view of the various components included in the inventive key safekeeping device. The first or the outer component, generally referenced 1, includes a tubular safekeeping element 10 whose diameter enables a key 8 to be placed therein; see FIG. 3. The safekeeping tubular element has a through-penetrating aperture or hole 10*a* and includes an external thread 10*b* at its outer end portion. The safekeeping tubular element also includes external threads 10*c* further along the tube.

An outer ring 12 is provided internally with a peripherally extending aperture 12*a* intended for co-action with a lock cylinder 14, as described below. The internal aperture 12*a* has a larger diameter than the remainder of the internal surface 12*c* of the outer ring. As will be seen from FIG. 3, the outer ring also includes an internal thread 12*b* adapted for co-action with the external thread 10*b* of said safekeeping tubular element.

The aforementioned lock cylinder 14 is essentially cylindrical and has, conventionally, a rotatable plug 14*a*. The plug includes a key slot for receiving a key 16, wherein the plug can be rotated upon insertion of the correct key. The plug includes a latching element 14*b* which enters the opening in the through-penetrating hole 10*a* of the safekeeping tubular element when the plug is turned by means of the key 16, as described in the above-mentioned patent specification SE 506 752 which is included in this document by way of reference. A guide shoulder 10*d* is provided in the safekeeping tubular element to this end, so as to ensure that when inserted, the lock cylinder 14 will be orientated so as to enable the latching element 14*b* to engage in the opening 10*a* in the tubular element.

The lock cylinder also includes at said front end surface, i.e. the end surface in which the plug is arranged, a collar or an end portion 14*c* whose diameter is larger than that of the remainder of the lock cylinder. The outer diameter of the collar 14*c* is slightly smaller than the inner diameter of the aperture 12*a* of the outer ring, whereby it harmonizes with the stepped inner diameter of the outer ring and the lock cylinder 14 can be inserted into the outer ring 12 until the collar 14*c* on the lock cylinder rests in the ring aperture 12*a*. The front-end surface of the lock cylinder will then lie on the same level as the front-end surface of the outer ring; see FIG. 3. The end portion 14*c*, however, has a larger diameter than that of the remainder 12*c* of the outer ring. Mounting of the outer part 1 will be described in more detail below, with reference to FIGS. 4*a–f*.

Unauthorized manipulation of the key safekeeping device from outside the door is prevented by virtue of the fact that the outer ring cannot be removed without first removing the lock cylinder.

The second part or inner part, generally referenced 2, includes a tubular anchoring element 20 that has an inner diameter which slightly exceeds the-outer diameter of the safekeeping tubular unit 10. As will be seen from FIG. 3, the anchoring element includes an internal thread 20*a* which is adapted to co-act with external threads 10*c* on the safekeeping tubular element. This enables the safekeeping tubular element 10 and the anchoring element 20 to be screwed together to form a tubular unit, the length of which can be adapted by screwing together said two parts until an appropriate length is obtained.

The anchoring element 20 includes a plurality of elongate openings or holes 20*b*, in the illustrated case four such openings or holes. Similar to the hole 10*a* in the safekeeping tubular element, these openings or holes are intended to receive a latching element 14*b* on the lock cylinder, as described in the patent specification referred to above. This arrangement further blocks relative rotation between the safekeeping tubular element 10 and the anchoring element 20 after having screwed said elements together.

The inner end portion of the barrel surface of the anchoring element 20 includes a number of circumferential grooves 20*c*. These grooves are intended to fixate the position of an inner ring 22 with the aid of a wire clip 24 made of resilient material, such as spring steel, and bent into a ring shape. The inner ring 22 is provided with an internal aperture 22*a* to this end; see FIGS. 1 and 3. This enables the inner ring to be fixed in any one of a number of positions, so as to enable the key safekeeping device to be adapted readily to doors of different thicknesses; the clip 24 is, at the same time, hidden from view when the safekeeping device is fitted. Unlawful or unauthorized manipulation from inside the door is also prevented in this way.

Figure 3:
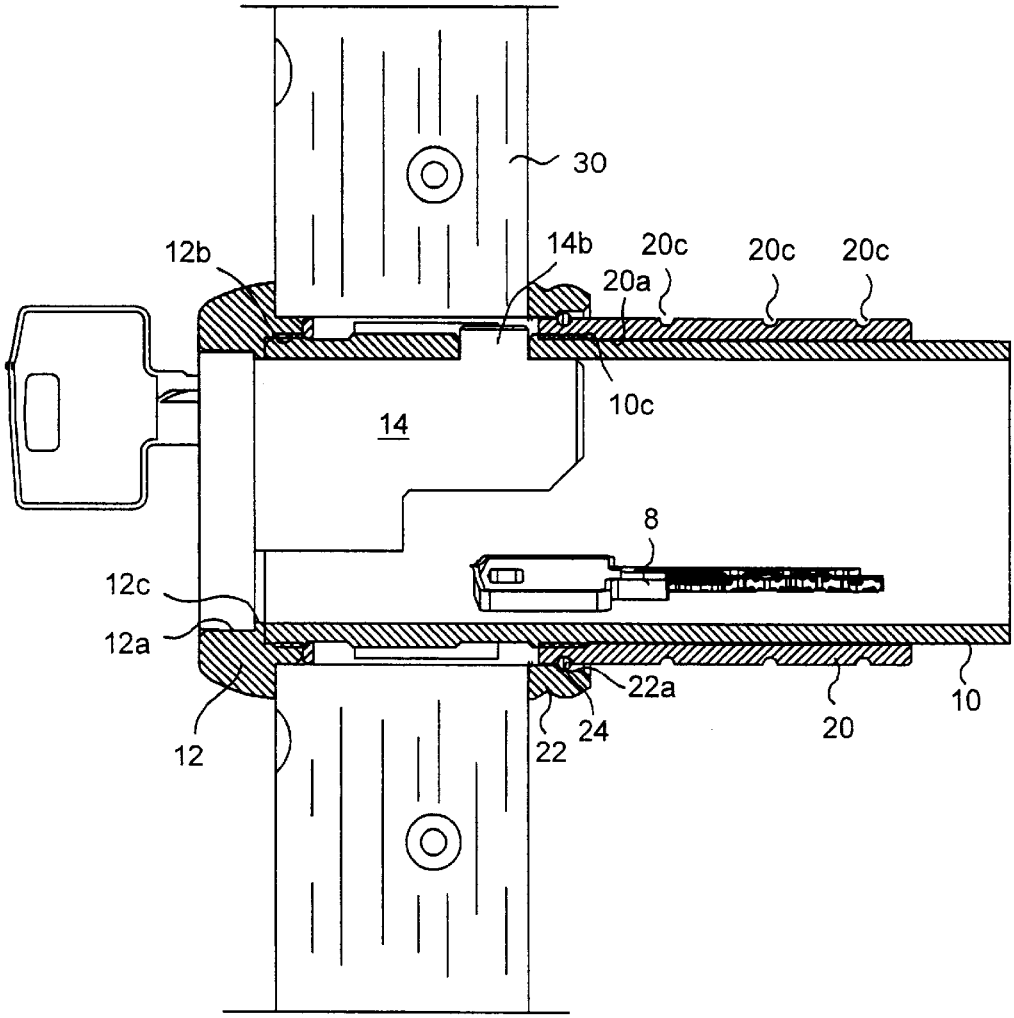
FIG. 3 is a sectional view of the inventive key safekeeping device fitted to a door.

FIG. 3 is a sectional view of the key safekeeping device when fitted to a door, referenced 30 in the figure. The lock cylinder 14 is shown with its latching element 14*b* in engagement with the safekeeping tubular element and the anchoring element and cannot therefore be removed from the safekeeping tubular element unless the key is turned so as to bring the latching element to a non-engaging position. Provided the lock cylinder is fixed in the tubular element, its collar 14*c* prevents the outer ring 12 from being unscrewed, since it has a larger diameter than the part 12*c* of said ring. An unauthorized person is therewith unable to dismantle the key safekeeping device from outside the door. The clip 24 blocks dismantling of the inner ring 22 in a corresponding manner.

Fitting of the key safekeeping device will now be described in detail with reference to FIGS. 4*a–f*.

The outer ring 12 is initially screwed to its maximum extent on the safekeeping tubular element 10. The tubular element 10 and the anchoring element 20 are then screwed together, whereafter the safekeeping tubular element, onto which the outer ring has been screwed, and the anchoring element are inserted from the outside into a through-penetrating hole provided to this end in a door, a wall or some corresponding structure in which the key safekeeping device shall be fitted; see FIG. 4*b*.

Figure 4A:
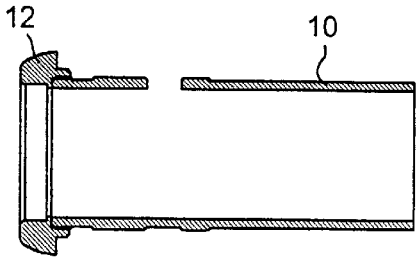
FIGS. 4*a–f* show the steps of fitting a key safekeeping device according to the invention.
Figure 4D:
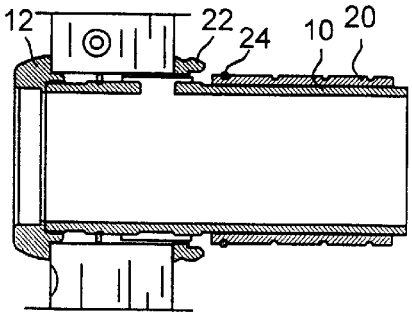
Figure 4B:
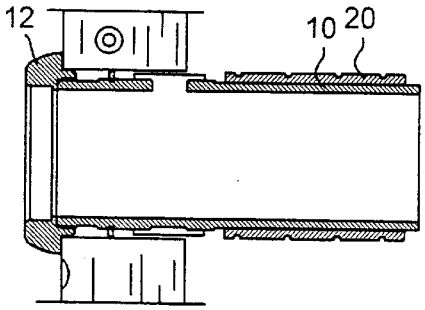
Figure 4E:
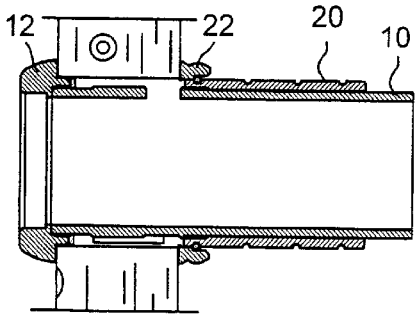
Figure 4C:
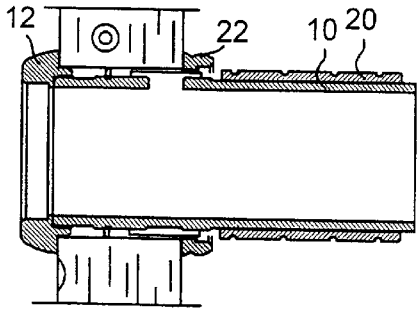

The inner ring 22 is then fitted over the anchoring element, so that the planar end of the ring lies against the inner surface of the door; FIG. 4*c*. With the inner ring in this position, the clip 24 is fitted over the anchoring element and placed in an appropriate circumferential groove, FIG. 4*d*, whereafter the anchoring element 20 is screwed tight, i.e. screwed over the safekeeping tubular element 10 until the inner ring is clamped firmly between the inner surface of the door and the clip 24; see FIG. 4*e*. It is ensured in this regard that one of the elongate openings 20*b* in the anchoring element coincides with the holes 10*a* in the safekeeping tubular element. The clip is essentially hidden from view by the inner ring in this position, therewith preventing the clip from being removed without first unscrewing the tubular element 10 and the anchoring element 20.

Figure 4F:
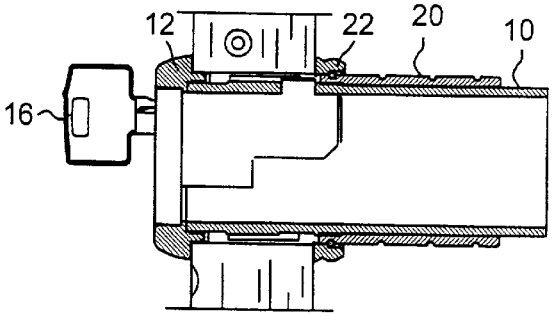

Finally, the safekeeping tubular element 10 and the anchoring element 20 are locked against relative rotation, by inserting the lock cylinder 14 into the tubular element 10 and thereafter rotating the plug with the aid of the correct key 16, so as to bring the latching element 14*b* into engagement with the hole 10*a* in the safekeeping tubular element and the elongate opening 20*b* that coincides with the hole 10*a*; see FIG. 4*f*.

Figure 5A:
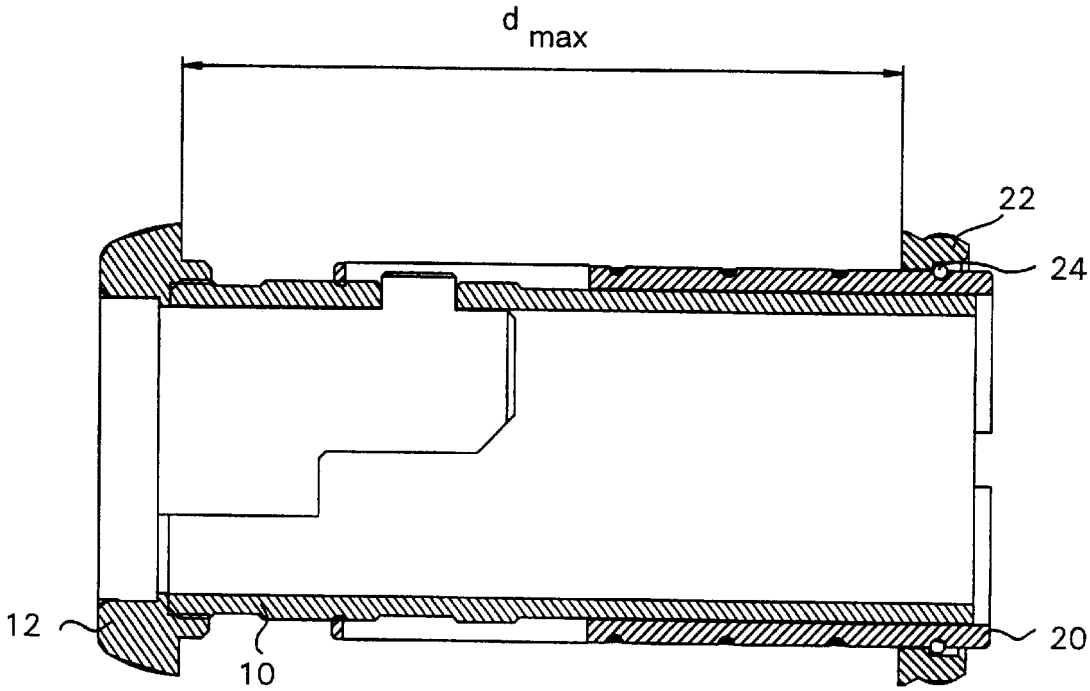
FIGS. 5*a* and 5*b* illustrate respectively a maximum and a minimum door thickness for accommodating an inventive key safekeeping device.
Figure 5B:
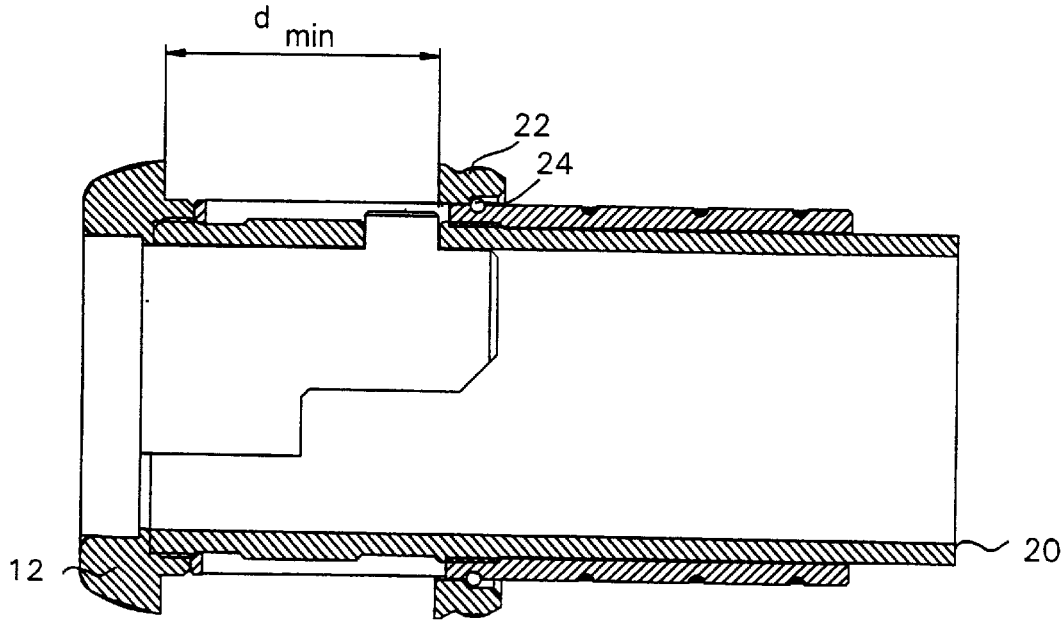

As will be evident from FIGS. 5*a* and 5*b*, the inventive key safekeeping device is highly adaptable to suit doors or walls of mutually different thicknesses to which it shall be fitted, these thicknesses being referenced $d_{max}$ and $d_{min}$ in the figures. FIG. 5*a* shows a maximum thickness. In this case, the clip 24 has been placed in the groove 20*c* that lies proximal to the inner end of the anchoring element 20. On the other hand, in FIG. 5*b* the clip has been placed in the groove 20*c* that lies distal from said inner end.

Although an embodiment of an inventive key safekeeping device has been described in the aforegoing, the person skilled in this particular field will understand that this embodiment can be modified within the scope of the accompanying claims. An alternative embodiment (not shown in the drawings) is intended to be fitted in a wall that lacks a through-penetrating opening. In this embodiment, the anchoring element is firmly molded in the opening and thus has no inner ring. On the other hand, in the case of this alternative embodiment, the concept of the invention can be applied to the safekeeping tubular element, which may be identical to the tubular element described in conjunction with the preferred embodiment.

The illustrated anchoring element 20 has four equidistant elongate openings 20*b*. Consequently, in order to cause the holes 10*a* in the safekeeping tubular element to coincide with an elongate opening 20*b* in the anchoring element, it will sometimes be necessary to rotate these two elements through an angle of 45 degrees in order to achieve this position. If a smaller angle of rotation is desired, the anchoring element can be provided with more than four elongate openings.

Although the grooves 20*c* provided in the barrel surface of the anchoring element have been described as fully circumferential grooves, it will be understood that the same function can be achieved also with grooves that do not extend around the full periphery of said barrel surface, but only around a part thereof. Although the inventive device has been described as including four grooves, it will be understood that the device may include any number of grooves, provided that the device can be adapted appropriately to the thickness of the door to which it shall be fitted.

The wire clip 24 has been shown to have a ring shape that extends essentially around the full periphery of the anchoring element. It will be understood, however, that the clip may have any suitable form that enables it to fixate the inner ring 22 when fitting/assembling the key safekeeping device. However, it is practical with respect to fitting the device that the clip extends more than half way around the anchoring element, so that it will remain in place even before the inner ring is fitted in position over the clip.

What is claimed is:

1. A key safekeeping device for fitting into a hole in a door, wall or like structure, wherein the device comprises:

a first tubular element that has a first collar provided on an outer end thereof;

a lock cylinder detachably mounted on said outer end of the first tubular element;

a second tubular element which has a second collar and which lockably engages said first tubular element, wherein at least one of said first and said second collars is comprised of a separate ring-shaped part;

wherein said key safekeeping device further comprises a blocking means blocking dismantling of said ring-shaped part, wherein said blocking means cannot be removed when said key safekeeping device is fitted and said lock cylinder is mounted, and said blocking means includes a bent or curved element which is fitted in a peripheral groove in the barrel surface of said second tubular element; and said ring-shaped part includes an internal aperture which receives said bent/curved element thereby preventing removal of said element when the key safe-keeping device is fitted in position.

2. The device according to claim 1, wherein the barrel surface of the second tubular element includes a plurality of peripheral grooves for receiving said blocking means.

3. The device according to claim 2, wherein said plurality of peripheral grooves are adapted for fitting the device to doors, walls or like structures of different thicknesses.

4. The device according to claim 1, wherein said blocking element extends essentially around the full periphery of said second tubular element.

5. The device according to claim 4, wherein said device includes a second ring-shaped part and a second blocking means, wherein said second blocking means includes a lock cylinder end-portion whose diameter is larger than the diameter of an internal surface of said second ring-shaped part.

6. The device according to claim 5, wherein said second ring-shaped part has an internal aperture for receiving the lock cylinder end-portion.

7. The device according to claim 1, wherein said second tubular element has a thread for screw engagement with a thread on the first tubular element.

8. The device according to claim 1, wherein said lock cylinder has a latching element for engagement in openings in said first and said second tubular elements.

9. The device according to claim 1, wherein said bent/curved element extends around more than half of the barrel surface of said second tubular element.

10. The device according to claim 9, wherein said bent/curved element is discontinuous so that it does not extend around the entire barrel surface of said second tubular element.

11. The device according to claim 1, wherein said bent/curved element is made of a resilient material.

* * * * *